US009639043B1

(12) United States Patent
Kimura et al.

(10) Patent No.: US 9,639,043 B1
(45) Date of Patent: May 2, 2017

(54) HEATER AND FIXING DEVICE

(71) Applicant: Toshiba Lighting & Technology Corporation, Yokosuka-shi, Kanagawa (JP)

(72) Inventors: Kentaro Kimura, Yokosuka Kanagawa (JP); Satoko Kato, Yokosuka Kanagawa (JP); Takanobu Ueno, Yokosuka Kanagawa (JP)

(73) Assignee: Toshiba Lighting & Technology Corporation, Yokosuka-shi (JP)

( * ) Notice: Subject to any disclaimer, the term of this patent is extended or adjusted under 35 U.S.C. 154(b) by 0 days.

(21) Appl. No.: 15/265,325

(22) Filed: Sep. 14, 2016

(30) Foreign Application Priority Data

Feb. 29, 2016 (JP) ..... 2016-037428

(51) Int. Cl.
*G03G 15/20* (2006.01)
*H05B 3/00* (2006.01)
*H05B 3/26* (2006.01)

(52) U.S. Cl.
CPC ..... *G03G 15/2053* (2013.01); *G03G 15/2042* (2013.01); *G03G 15/2078* (2013.01); *G03G 15/2082* (2013.01); *H05B 3/0014* (2013.01); *H05B 3/26* (2013.01); *H05B 2203/019* (2013.01)

(58) Field of Classification Search
None
See application file for complete search history.

(56) References Cited

U.S. PATENT DOCUMENTS 8,552,342 B2 * 10/2013 Sakakibara ..... H05B 3/0095 219/216
8,841,587 B2 * 9/2014 Tsuruya ..... G03G 15/2042 219/216
9,086,663 B2 * 7/2015 Shimura ..... H05B 3/0095
9,095,003 B2 * 7/2015 Sakakibara ..... H05B 3/0095
9,445,457 B2 * 9/2016 Sakakibara ..... H05B 3/0095
2009/0230114 A1 * 9/2009 Taniguchi ..... G03G 15/2042 219/216
2011/0062140 A1 * 3/2011 Sakakibara ..... H05B 3/0095 219/216
2012/0121306 A1 * 5/2012 Shimura ..... H05B 3/0095 399/329
2012/0201582 A1 * 8/2012 Shimura ..... H05B 3/0095 399/329
2012/0269535 A1 * 10/2012 Mine ..... G03G 15/2053 399/90
2012/0308280 A1 * 12/2012 Tsuruya ..... G03G 15/2042 399/329

(Continued)

FOREIGN PATENT DOCUMENTS

JP 2009-244867 A 10/2009

*Primary Examiner* — Joseph M Pelham
(74) *Attorney, Agent, or Firm* — Ulmer & Berne LLP

(57) ABSTRACT

According to one embodiment, a heater includes an elongated substrate; a conductor that is provided on the substrate along a longitudinal direction of the substrate; and a plurality of resistance heating elements which are respectively disposed on the substrate along the longitudinal direction of the substrate, are electrically connected to each other in series by the conductor, and of which each resistance temperature coefficient becomes smaller as the resistance heating elements approach end regions in the longitudinal direction of the substrate.

4 Claims, 6 Drawing Sheets

(56) References Cited

U.S. PATENT DOCUMENTS

| | | | | |
|---|---|---|---|---|
| 2013/0251428 | A1* | 9/2013 | Ueno | H05B 3/12 399/333 |
| 2013/0343791 | A1* | 12/2013 | Shimura | G03G 15/2053 399/329 |
| 2014/0003848 | A1* | 1/2014 | Sakakibara | H05B 3/0095 399/335 |
| 2015/0289317 | A1* | 10/2015 | Sakakibara | H05B 3/0095 399/329 |

* cited by examiner

FIG.2

ANALYSIS RESULT OF RESISTANCE ELEMENT PASTE

| | | No.1 | No.2 | No.3 | No.4 | No.5 | No.6 |
|---|---|---|---|---|---|---|---|
| CONDITION | SHEET RESISTANCE (Ω/□) | 58 | 1937 | 22326 | 1766 | 429920 | 200 |
| | RESISTANCE TEMPERATURE COEFFICIENT (ppm/°C) | -4023 | -5303 | -5483 | -5324 | -5548 | -840 |
| MASS % | B | - | - | - | - | 2.542 | - |
| | Al | 1.708 | 2.028 | 2.784 | 2.673 | 3.320 | 0.319 |
| | Si | 3.577 | 4.459 | 6.647 | 4.087 | 5.540 | 5.370 |
| | P | - | 0.266 | 0.430 | - | - | - |
| | S | - | - | - | - | - | 0.157 |
| | K | - | - | - | - | - | 0.401 |
| | Ca | - | - | - | 0.169 | - | - |
| | Ti | - | - | - | - | - | 1.003 |
| | Mn | 23.241 | 20.074 | 20.035 | 29.224 | 21.589 | 31.130 |
| | Fe | - | 0.343 | - | 0.340 | 0.397 | 0.425 |
| | Co | 7.126 | 6.353 | 4.744 | 8.629 | 16.944 | - |
| | Cu | 18.146 | 22.868 | 18.154 | 18.669 | 6.870 | - |
| | Zn | - | - | - | - | - | 1.843 |
| | Ru | 30.502 | 13.438 | 2.135 | 11.753 | 9.289 | 58.250 |
| | Ag | - | - | - | - | - | 1.102 |
| | Pb | 15.700 | 30.170 | 45.071 | 24.456 | 33.508 | - |
| | Total | 100.000 | 100.000 | 100.000 | 100.000 | 100.000 | 100.000 |

HEATER AND FIXING DEVICE

CROSS-REFERENCE TO RELATED APPLICATION

This application is based upon and claims the benefit of priorities from Japanese Patent Application No. 2016-037428 filed on Feb. 29, 2016; the entire contents of which are incorporated herein by reference.

FIELD

Embodiments described herein relate generally to a heater and a fixing device.

BACKGROUND

A heater is used in an electronic apparatus such as an Office Automation (OA) apparatus, home electric appliances, and precision manufacturing equipment. The heater is used in a fixing device for fixing toner to a sheet in a fixing device such as a copying machine and a facsimile. In addition, the heater is used for erasing a print and the like in a rewritable card reader. The heater is configured by forming power supply electrodes, a conductor, and a resistance heating element on a substrate, and the resistance heating element generates heat by electric power supplied from the power supply electrodes.

In general, the heater used in the fixing device has silver and palladium, or ruthenium oxide, and glass as main components, and the resistance heating element having a Positive Temperature Coefficient (PTC) characteristic of which a resistance temperature coefficient [ppm/° C.] is 0 or positive is used.

The heater has an effective length that matches a maximum size (length of paper in a direction parallel to a longitudinal direction of the heater) of a recording medium (paper) which can be heated by the fixing device, that is, the effective length is equal to or greater than the maximum size. Therefore, when heating the recording medium that is smaller than the maximum size, in the heater having the PTC characteristic, a temperature of a region of a paper non-passing portion rises in a longitudinal direction of the heater. Then, if priority is given to suppressing the temperature rise in the region of the paper non-passing portion, it can be considered that a resistance heating element having a Negative Temperature Coefficient (NTC) characteristic of which the resistance temperature coefficient [ppm/° C.] is negative is used in the heater.

A heater 1D of related art is described with reference to FIG. 5. If resistance heating elements 5-1 and 5-2 of the heater 1D are formed of a material having the PTC characteristic, when paper having a size smaller than a size that is able to be carried continuously passes through the heater 1D, paper is not deprived of heat in the paper non-passing portion. Therefore, the temperature of the paper non-passing portion rises. Particularly, when thick paper having a small size passes through the heater 1D in large quantities, in order to raise the temperature that is lowered by the paper passing portion, large electric power is supplied on the heater 1D. As a result, the temperature of the paper non-passing portion excessively rises and there is a concern that a component such as a heating roller is led to deterioration and damage. In order to suppress the temperature rise of the paper non-passing portion, it is conceivable to form the resistance heating elements 5-1 and 5-2 with a material having the NTC characteristic. In the resistance heating element having the NTC characteristic, a resistance value is lowered as the temperature rises. Therefore, a heating amount of the resistance heating elements 5-1 and 5-2, which are the paper non-passing portion in end regions in a longitudinal direction of a substrate 2, is lowered and it is possible to suppress the temperature rise in the paper non-passing portion.

However, if the NTC characteristic of the resistance heating elements 5-1 and 5-2 is large, for example, when thermal runaway of the heater 1D is generated due to failure of a thermistor which performs temperature control and the like, the heating amount is excessively increased. Since the resistance heating elements 5-1 and 5-2 are not formed in both ends of the substrate 2, the temperature rise is small. As a result, a temperature difference in the longitudinal direction of the substrate 2 is great and excessive heat stress is generated. Since the heat stress exceeds breaking strength of the heater 1D in a short period of time, a phenomenon in which cracking occurs in the end portions of the heater 1D is generated.

If the resistance heating element of which the NTC characteristic is large is used as a heating element used in the heater, when the temperature of the paper non-passing portion of the heater excessively rises, the resistance value is lowered and then the temperature rise of the paper non-passing portion is suppressed. However, if a component such as the thermistor, which performs the temperature control of the heater, is failed, thermal runaway of the heater is generated, the heating amount is excessively increased, and thereby a phenomenon in which cracking occurs in the heater in a short period of time is likely to be generated.

Therefore, an object of an exemplary embodiment is to provide a heater, in which temperature rise of a paper non-passing portion of the heater is suppressed and damage of the heater is suppressed during thermal runaway, and a fixing device.

BRIEF DESCRIPTION OF THE DRAWINGS

FIG. 2 is a diagram illustrating compositions and resistance temperature coefficients of resistance heating element materials according to the first embodiment.

DETAILED DESCRIPTION

Figure 1:
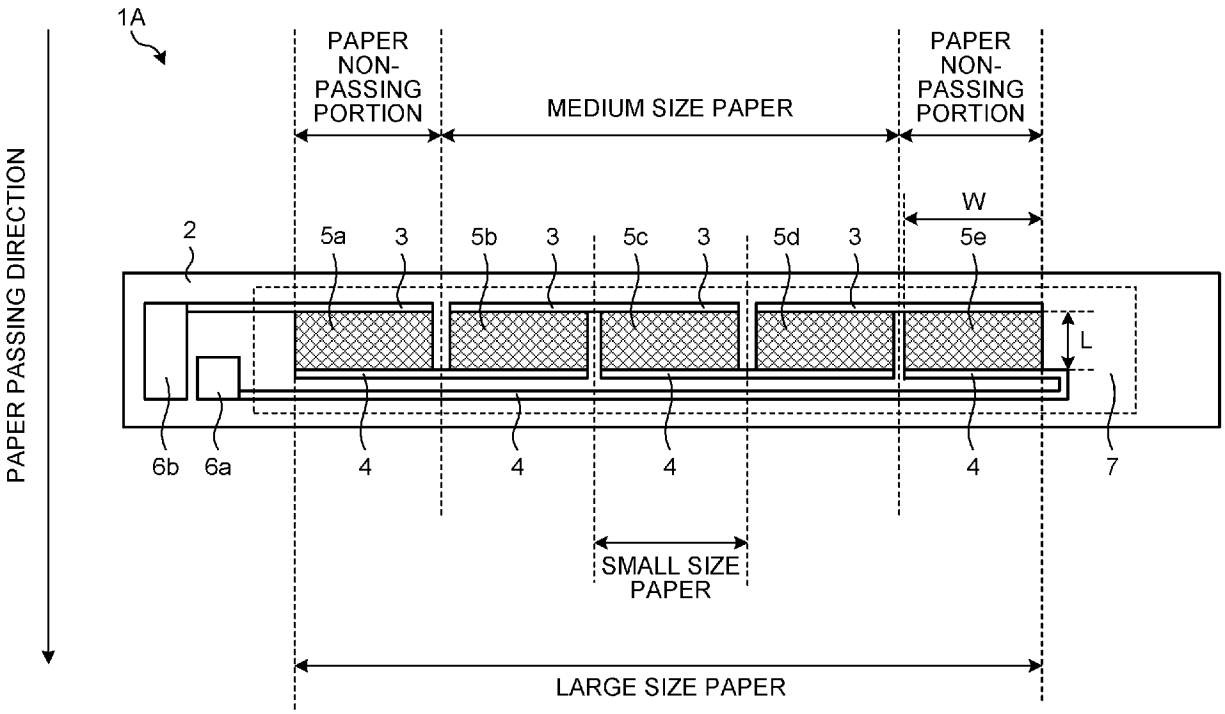
FIG. 1 is a schematic view illustrating a heater of a first embodiment.

In general, according to one embodiment, a heater includes an elongated substrate, a conductor, and a plurality of resistance heating elements. The conductor is provided on the substrate along a longitudinal direction of the substrate. The plurality of resistance heating elements are respectively disposed on the substrate along the longitudinal direction of the substrate. The plurality of resistance heating elements are electrically connected to each other in series by the conductor. Each resistance temperature coefficient of the plurality of resistance heating elements becomes smaller as the resistance heating elements approach end regions in the longitudinal direction of the substrate.

In addition, the plurality of resistance heating elements included in the heater according to the embodiment has an NTC characteristic. The resistance temperature coefficient of the resistance heating elements, positioned in the end regions in the longitudinal direction of the substrate, is −2000 [ppm/° C.] to −6000 [ppm/° C.].

In addition, in the heater according to the embodiment, the resistance heating elements, which are positioned in the end regions in the longitudinal direction of the substrate, contain 1 mass % to 30 mass % of at least one of ruthenium, iridium, and rhodium, and 25 mass % to 90 mass % of at least one of lead, cobalt, manganese, and copper is added to the resistance heating elements.

In addition, a fixing device according to an embodiment includes the heater and a roller. The heater heats a passing recording medium. The roller presses the recording medium when being heated by the heater. The heater heats the recording medium and the roller presses the recording medium, and thereby a toner image adhered to the recording medium is fixed.

Embodiments

Hereinafter, each embodiment will be described with reference to the drawings.

Moreover, the drawings are schematic and conceptual, and dimensions, proportions, and the like of each portion are not necessarily identical to those in reality. In addition, the same reference numerals are given to the same configurations and the same effects in each drawing, and description of overlapping portions will be omitted.

Hereinafter, a heater of a first embodiment will be described with reference to FIGS. 1 and 2.

As illustrated in FIG. 1, a heater 1A according to the embodiment includes an elongated substrate 2, a first conductor 3, a second conductor 4, a plurality of resistance heating elements 5 (5*a* to 5*e*), a overcoat layer 7 that covers the first conductor 3, the second conductor 4, and the resistance heating elements 5, and power supply electrodes 6*a* and 6*b*. The first conductor 3 and the second conductor 4 are formed to have a width which is constant in a lateral direction of the substrate 2, and are formed with a predetermined gap between each other along a longitudinal direction of the substrate 2.

The first conductor 3 and the second conductor 4 are formed along the longitudinal direction of the substrate 2 from electrodes 6 provided at one end in the longitudinal direction of the substrate 2, and are electrically connected to each of the resistance heating elements 5*a* to 5*e*. The resistance heating elements 5*a* to 5*e* have a NTC characteristic and are formed in a quadrilateral shape. The resistance heating elements 5*a* to 5*e* are disposed with predetermined gaps between each other along the longitudinal direction of the substrate 2 between the first conductor 3 and the second conductor 4, and are electrically connected to each other in series by the first conductor 3 and the second conductor 4. In general, a sheet resistance value of the resistance heating element 5 having the NTC characteristic is high and a total resistance value of the resistance heating element 5 formed in one heater is difficult to be used as commercial power supply. Then, as in the embodiment, a method, in which the resistance heating element 5 is divided into a plurality of resistance heating elements in the longitudinal direction of the substrate 2, the plurality of resistance heating elements 5*a* to 5*e* are respectively disposed, and a contact area with the first conductor 3 and the second conductor 4 is widely formed in a direction orthogonal to a paper passing direction of the resistance heating element 5, is employed.

As illustrated in FIG. 1, the plurality of resistance heating elements 5*a* to 5*e* are respectively disposed on the substrate 2 with predetermined gaps along the longitudinal direction of the substrate 2. When a width of each of the resistance heating elements 5*a* to 5*e* in the longitudinal direction of the substrate 2 is W and a length in the lateral direction is L, each of the resistance heating elements 5*a* to 5*e* is formed so as to satisfy W>L. Therefore, a contact length of the resistance heating elements 5*a* to 5*e* with the first conductor 3 and the second conductor 4 is increased and a number of paths through which a current flows are formed. Therefore, it is possible to lower the sheet resistance value. The resistance heating element 5 is formed as described above and thereby it is possible to efficiently heat a recording medium of sizes of various kinds and to generate the NTC characteristic of the resistance heating element 5.

Here, relationship between compositions and resistance temperature coefficients of the resistance heating element 5 is illustrated in FIG. 2. A plurality of kinds of resistance element paste are manufactured by changing a mixing ratio for a material of the resistance element paste forming the resistance heating element 5.

In the embodiment, the resistance heating elements 5*b* to 5*d* disposed in a center region of the heater 1A in the longitudinal direction of the substrate 2 are formed of resistance element paste containing, for example, 20 mass % to 80 mass % of at least one of ruthenium (Ru), iridium (Ir), rhodium (Rh), and the like as oxides, and to which 15 mass % to 60 mass % of titanium (Ti), manganese (Mn), iron (Fe), and the like are added as oxides. The resistance heating elements 5*a* and 5*e* disposed in end regions of the substrate 2 are formed of resistance element paste containing, for example, 1 mass % to 30 mass % of at least one of ruthenium (Ru), iridium (Ir), rhodium (Rh), and the like as oxides, and to which 25 mass % to 90 mass % of at least one of lead (Pb), cobalt (Co), manganese (Mn), copper (Cu), and the like are added as oxides. The resistance heating elements 5*a* to 5*e* are formed by coating the substrate 2 with the resistance element paste by screen printing or the like, drying, and baking the resistance element paste as a material. Moreover, in the resistance element paste, a sum of each material does not exceed 100 mass % and resistance element paste where the ratio of each material is included in the range described above in total 100 mass % is the exemplary embodiment.

According to the configuration, resistance temperature coefficients of the three resistance heating elements 5*b* to 5*d* disposed in the center region in the longitudinal direction of the substrate 2 is −600 [ppm/° C.] to −1000 [ppm/° C.]. In addition, resistance temperature coefficients of the two resistance heating elements 5*a* and 5*e* disposed in the end regions of the substrate 2 is −2000 [ppm/° C.] to −6000 [ppm/° C.]. In the embodiment, for example, as illustrated in FIG. 2, description will be given with reference to the resistance element paste manufactured under conditions from No 1 to No 6.

For example, the resistance element paste of No 6 is used for the resistance heating elements 5*b* to 5*d* disposed in the center region in the longitudinal direction of the substrate 2 and the resistance element paste of No 1 is used for the resistance heating elements 5*a* and 5*e* disposed in the end regions of the substrate 2. In this case, the resistance temperature coefficient of the resistance heating elements 5*b* to 5*d* is −840 [ppm/° C.] and the resistance temperature coefficient of the resistance heating elements 5*a* and 5*e* is −4023 [ppm/° C.] which is lower than that. If a medium size paper continuously passes through the heater 1A, the resistance heating elements 5*a* and 5*e* disposed in the end regions, are the paper non-passing portion and the temperature thereof rises. However, since the resistance temperature coefficient of the resistance heating elements 5*a* and 5*e* is lower than that of the resistance heating elements 5*b* to 5*d* disposed in the center region, a resistance value is lowered and the temperature rises, the heating amount is reduced, and it is possible to suppress the temperature rise.

In addition, when thermal runaway of the heater 1A is generated, the resistance value of the resistance heating elements 5*a* and 5*e* disposed in the end regions is rapidly decreased compared to that of the resistance heating elements 5*b* to 5*d* disposed in the center region in accordance with the temperature rise of the heater 1A. Therefore, in the heater 1A, since the heating amount of the end regions of the substrate 2 is lowered, the temperature is lowered, thermal stress is released, and then it is possible to suppress cracking of the end portion of the substrate 2.

In addition, each resistance temperature coefficient of the plurality of resistance heating elements 5 may be set such that the resistance temperature coefficient of the resistance heating element 5*c* disposed in the center region is the highest and the resistance temperature coefficient is stepwise smaller toward the end portions of the substrate 2. For example, the resistance heating element 5*c* disposed in the center region of the substrate 2 is formed of the resistance element paste of No 6 of FIG. 2, the resistance heating elements 5*b* and 5*d* on both sides adjacent to the resistance heating element 5*c* are formed of the resistance element paste of No 1, and the resistance heating elements 5*a* and 5*e* disposed in the end regions of the substrate 2 are formed of the resistance element paste of No 5.

For example, when a recording medium of a small size such as a postcard passes through the center region in the longitudinal direction of the substrate 2, an area of the region of the paper non-passing portion occupied in the heater 1A is wider than that of the region of the paper passing portion. In this case, in the end regions of the substrate 2, the resistance heating element 5 is formed such that the resistance temperature coefficient is smaller toward both ends of the substrate 2. Therefore, it is possible to efficiently perform suppression of the temperature rise of the paper non-passing portion in accordance with the sheet size. In addition, when thermal runaway of the heater 1A is generated, since the heating amount of the resistance heating element 5 in the paper non-passing portion is stepwise smaller as the resistance heating element approaches both end portions of the substrate 2, it is advantageous for the suppression of generation of the thermal stress.

Next, a second embodiment will be described with reference to FIG. 3.

Figure 3:
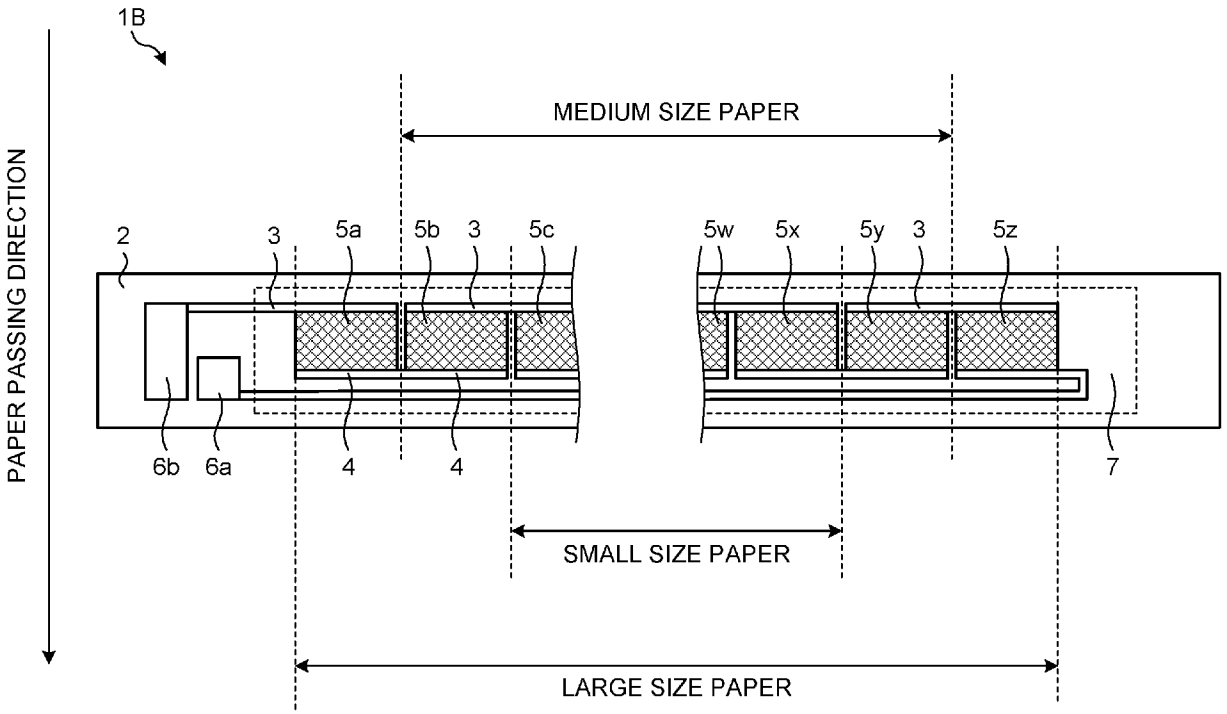
FIG. 3 is a schematic view illustrating a heater of a second embodiment.

The resistance heating element 5 of a heater 1B of the second embodiment illustrated in FIG. 3 is more finely divided in the longitudinal direction of the substrate 2 than the heater 1A of the first embodiment. In addition, it is preferable that a plurality of resistance heating elements 5*a* to 5*z* are formed such that each resistance temperature coefficient in the longitudinal direction of the substrate 2 is smaller toward both ends of the substrate 2. Therefore, the heater 1B can efficiently perform heating and suppression of the temperature rise of the paper non-passing portion in accordance with the sheet sizes of various kinds. Furthermore, it is advantageous for suppression of occurrence of thermal stress.

Next, a configuration of the resistance heating element 5 of the heater 1 and the temperature distribution in the longitudinal direction of the heater 1 when thermal runaway of the heater 1 is generated will be described with reference to FIGS. 4A and 4B.

Figure 4A:
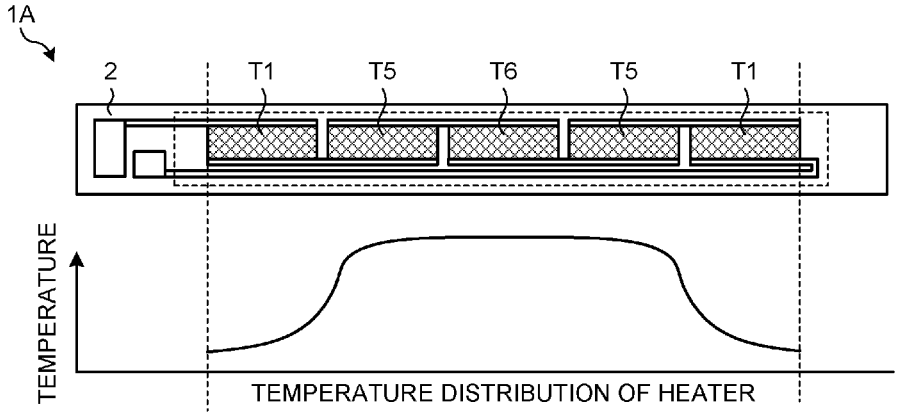
FIG. 4A is a view illustrating the heater of the first embodiment and a temperature distribution of the heater when thermal runaway of the heater is generated.
Figure 4B:
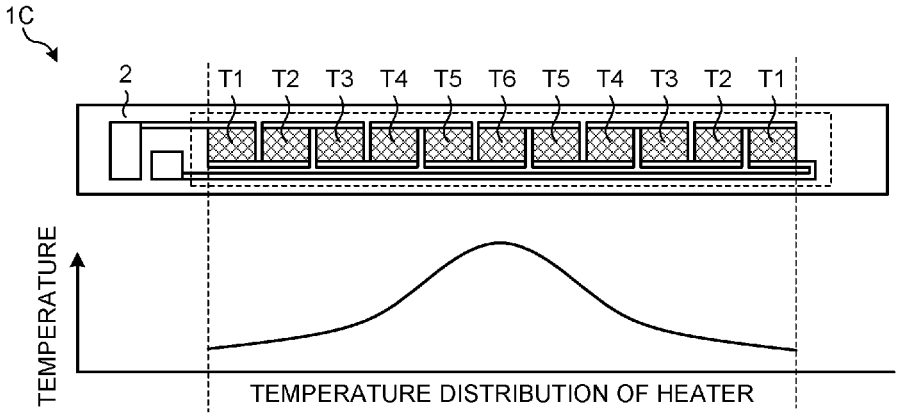
FIG. 4B is a view illustrating the heater of the second embodiment and a temperature distribution of the heater when thermal runaway of the heater is generated.
Figure 5:
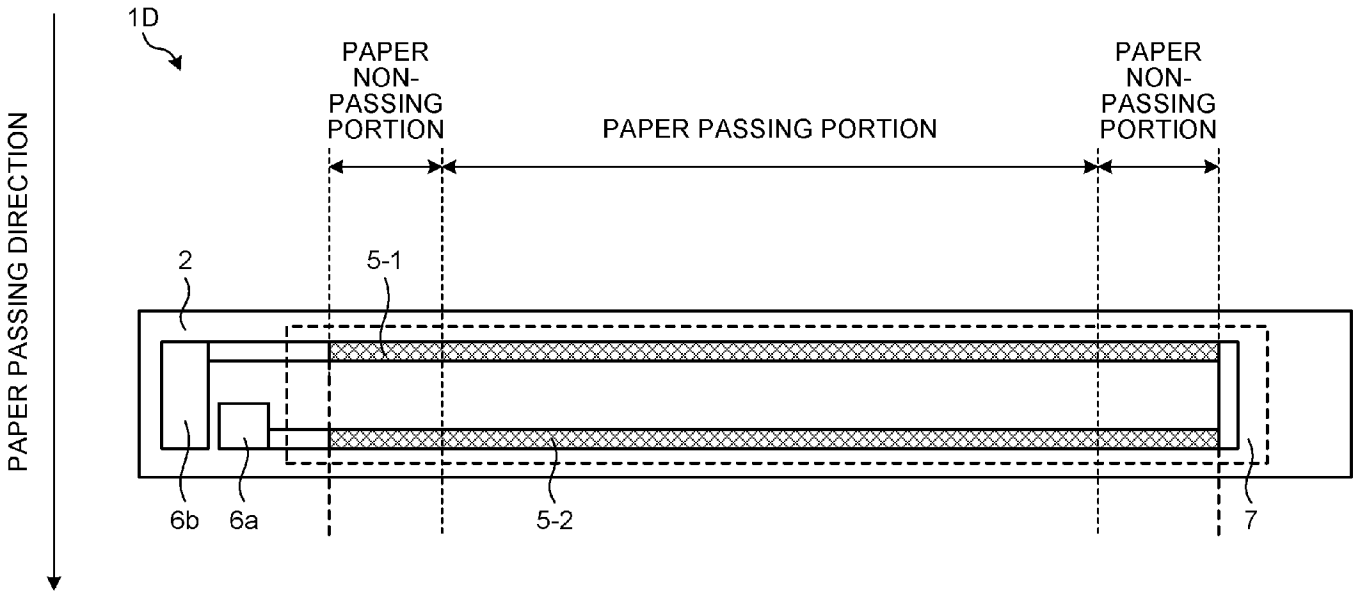
FIG. 5 is a schematic view illustrating a heater of related art.

In the heater 1A and the heater 1C illustrated in FIGS. 4A and 4B, the number of the plurality of resistance heating elements 5 disposed in the longitudinal direction of the substrate 2 is different. In other words, the resistance heating element 5 of the heater 1C is provided to be more finely divided in the longitudinal direction of the substrate 2 than the heater 1A. In addition, the plurality of resistance heating elements 5 provided in the heaters 1A and 1C are formed such that each resistance temperature coefficient thereof is smaller toward the end regions of the substrate 2. Here, a case where conditions of the resistance temperature coefficient are T1 to T6 and sizes of the resistance temperature coefficients have a relationship of T1<T2<T3<T4<T5<T6 will be described.

For example, for each resistance temperature coefficient of the plurality of resistance heating elements 5 provided in the heater 1A, the resistance heating element 5 of the center region in the longitudinal direction of the substrate 2 is formed under T6, the two resistance heating elements 5 adjacent to the resistance heating element 5 having T6 are formed under T5, the resistance heating elements 5 in the end regions of the substrate 2 are formed under T1 that is the smallest value. For each resistance temperature coefficient of the plurality of resistance heating elements 5 provided in the heater 1C, the resistance heating element 5 in the center region of the substrate 2 is formed under T6 that is the largest value, the resistance heating elements 5 are formed such that the resistance temperature coefficient thereof is stepwise smaller toward the end regions of the substrate 2, and the resistance heating elements 5 formed in both ends of the substrate 2 are formed under T1 that is the smallest value.

When thermal runaway of the heater 1A is generated, the resistance temperature coefficients of T5 and T1 are formed to be smaller than that of T6 of the center region. Therefore, the heating amount is lowered together with the temperature rises. In this case, a difference between the resistance temperature coefficients of T5 and T1 is large and thereby the temperature distribution of the heater 1A is, as illustrated in FIG. 4A, a curve that is rapidly decreased near a boundary between T5 and T1.

When thermal runaway of the heater 1C is generated, each resistance temperature coefficient of the plurality of resistance heating elements 5 is formed so as to be stepwise smaller from T6 to T1 toward the end regions of the substrate 2. Therefore, the heating amount is reduced stepwise as the temperature rises. Thus, as illustrated in FIG. 4B, the temperature distribution of the heater 1C is a curve of which the center region of the substrate 2 becomes a peak and which is lowered gradually toward the end regions of the substrate 2.

There is a difference between the heater 1A and the heater 1C in the number of the plurality of resistance heating elements 5 and a condition T of each resistance temperature coefficient during thermal runaway. Therefore, the temperature distribution in the longitudinal direction of the substrate 2 is different. In the heater 1A, the generation of the thermal stress is suppressed and it is possible to suppress cracking of the end portions of the substrate 2, but the temperature distribution is rapidly changed in a boundary portion from a high temperature to a low temperature in the longitudinal direction of the substrate 2. Therefore, the thermal stress may be generated in the boundary portion. On the other hand, in the heater 1C, the temperature is lowered gradually from the center region toward the end regions in the longitudinal direction of the substrate 2. Therefore, the generation of thermal stress is further suppressed and it is further advantageous for suppressing cracking of the end portions of the substrate 2.

The number, the column number, and the resistance temperature coefficient of the resistance heating elements 5 which are divided into plurality of resistance heating elements in the longitudinal direction of the substrate 2 are not limited to the embodiment, and may be appropriately changed in accordance with the kind and the application of the heater 1A. The resistance temperature coefficient of the resistance heating element 5 may be formed to be lowered toward the end regions of the substrate 2 and the number and the column number of the resistance heating elements 5 are not limited.

The substrate 2 has heat resistance and insulating properties, and is formed in a rectangular shape in the embodiment. The substrate 2 is a flat plate of which a thickness is, for example, 0.5 [mm] to 1.0 [mm] and is formed of ceramic such as alumina, glass ceramic, refractory composites, or the like. The shape of the substrate 2 is not limited to the embodiment as long as sides respectively extending in the lateral direction and the longitudinal direction intersecting the lateral direction are provided.

The first conductor 3 and the second conductor 4 are formed on the substrate 2, and power is supplied on the resistance heating element 5. The first conductor 3 and the second conductor 4 are formed using a silver (Ag) based conductive material of which a resistance value is low. Therefore, flow of a current is facilitated and it is possible to further increase the NTC characteristic of the resistance heating element 5.

The overcoat layer 7 covers the first conductor 3, the second conductor 4, and the resistance heating element 5 formed on the substrate 2 and is formed in a strip shape in the embodiment. The overcoat layer 7 is a glass layer that is formed by, for example, adding 3 mass % to 25 mass % of an inorganic oxide filler such as alumina which is excellent in the thermal conductivity.

By the overcoat layer 7 covering the first conductor 3, the second conductor 4, and the resistance heating element 5, direct exposing of the first conductor 3, the second conductor 4, and the resistance heating element 5 to the atmosphere is avoided. The overcoat layer 7 suppresses the damage and failure of the first conductor 3, the second conductor 4, and the resistance heating element 5 due to interferences (for example, mechanical, chemical, and electrical interferences) from outside.

Figure 6:
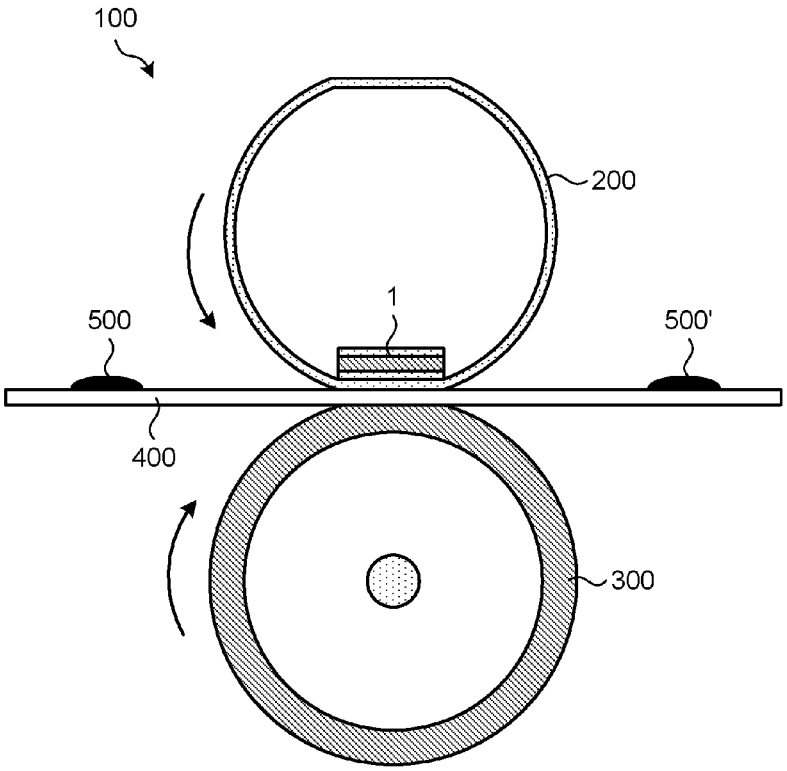
FIG. 6 is a schematic view illustrating a fixing device that is a using example of the heater.

Next, an embodiment of a fixing device 100 including the heater 1 will be described. FIG. 6 is a schematic view illustrating the fixing device 100 that is a using example of the heater 1. The fixing device 100 includes the heater 1, a fixing film 200, and a pressing roller 300. Moreover, the fixing device 100 is actually built into an image forming apparatus and the image forming apparatus is omitted.

The fixing film 200 is a roll-shaped film formed of a heat-resistant sheet such as polyimide resin. The heater 1 is disposed in a bottom portion of the fixing film 200.

The pressing roller 300 is a roller that is rotatably configured by a rotation shaft. A silicone rubber layer is formed on a surface of the pressing roller 300 as a heat-resistant elastic material. The silicone rubber layer is in elastically deformable contact with the heater 1 via the fixing film 200.

The heater 1 is energized, heat is generated in the resistance heating element 5, and the heat is added to the fixing film 200 and the pressing roller 300 via the substrate 2. Here, a sheet 400 to which a toner image 500 is adhered is fed by rotation of the fixing film 200 and the pressing roller 300, and thereby the toner image 500 is heated, softened, and melted. Thereafter, the sheet 400 is separated from the heater 1 on the sheet discharge side of the pressing roller 300, a toner image 500' is naturally heat-dissipated, cooled, and solidified. Then, the sheet 400 is separated from the fixing device.

According to the embodiment, it is possible to realize the fixing device 100 having high operation reliability by using the heater 1 in which suppression of the temperature rise of the paper non-passing portion and suppression of cracking of the substrate during thermal runaway can be achieved.

Moreover, in the embodiment, an example in which the heater 1 is used for fixing toner of the fixing device 100 is described. However, the example is not limited to the embodiment. An exemplary embodiment can be used as a heat source for heating or warming by mounting on, for example, home electric appliances, precision equipment for commercial or experimental use, equipment for chemical reactions, or the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes may be made without departing from the spirit of the inventions. The embodiments and modifications thereof fall within the scope and sprit of the invention and are included in the invention as described in the appended claims and the scope of equivalents thereof.

What is claimed is:

1. A heater comprising:

an elongated substrate;

a conductor that is provided on the substrate along a longitudinal direction of the substrate; and a plurality of resistance heating elements which are respectively disposed on the substrate along the longitudinal direction of the substrate, are electrically connected to each other in series by the conductor, and of which each resistance temperature coefficient decreases as the resistance heating elements approach end regions in the longitudinal direction of the substrate.

2. The heater according to claim 1, wherein the plurality of resistance heating elements has an NTC characteristic and a resistance temperature coefficient of the resistance heating elements, positioned in the end regions in the longitudinal direction of the substrate, is −2000 [ppm/° C.] to −6000 [ppm/° C.].

3. The heater according to claim 1, wherein the resistance heating elements, which are positioned the end regions in the longitudinal direction of the substrate, contain 1 mass % to 30 mass % of at least one of ruthenium, iridium, and rhodium, and 25 mass % to 90 mass % of at least one of lead, cobalt, manganese, and copper is added to the resistance heating elements.

4. A fixing device comprising:

the heater according to claim 1 that heats a passing recording medium; and a roller that presses the recording medium when being heated by the heater, wherein the heater heats the recording medium and the roller presses the recording medium, and thereby a toner image adhered to the recording medium is fixed.

* * * * *